United States Patent [19]

Holce et al.

[11] Patent Number: 4,943,791

[45] Date of Patent: Jul. 24, 1990

[54] WIDE GAP MAGNETIC REED SWITCH AND METHOD FOR MANUFACTURE OF SAME

[75] Inventors: Thomas J. Holce; Keith E. Flint, both of Portland, Oreg.

[73] Assignee: Sentrol, Inc., Portland, Oreg.

[21] Appl. No.: 301,803

[22] Filed: Jan. 25, 1989

[51] Int. Cl.[5] ..... H01H 1/66

[52] U.S. Cl. ..... 335/153; 335/151

[58] Field of Search ..... 335/151–153, 335/205–207

[56] References Cited

U.S. PATENT DOCUMENTS

| | | | |
|---|---|---|---|
| 3,771,083 | 11/1973 | Wessel | 335/153 |
| 4,165,501 | 8/1979 | Bongort et al. | 335/153 |
| 4,213,110 | 7/1980 | Holce | 335/205 |

*Primary Examiner*—Leo P. Picard
*Assistant Examiner*—Lincoln Donovan
*Attorney, Agent, or Firm*—Chernoff, Vilhauer, McClung & Stenzel

[57] ABSTRACT

A magnetically actuated reed switch assembly in which a small permanent helper magnet is attached to a magnetic lead of the reed switch at an end of the reed switch envelope. The lead then may be bent around parallel with a magnetic reed of an encapsulated reed switch. The permanent helper magnet provides an axis of magnetic polarity parallel with the axis of the reed switch, and is magnetized to a level of magnetism which supplies slightly less than enough magnetic flux density to hold the reed switch in a magnetically actuated condition, so that only a small amount of additional flux density needs to be provided. By selecting reed switches within close tolerances and using helper magnets of selected size and strength within close tolerances, satisfactory assemblies may be produced without adjustment of helper magnet position to actuate the switch. The small permanent magnet may alternatively define a bore fitting around the magnetic lead, and may be magnetized after assembly of the magnet and magnetic lead of the switch, thus reducing the amount of time and labor required to manufacture the switch assembly.

8 Claims, 3 Drawing Sheets

WIDE GAP MAGNETIC REED SWITCH AND METHOD FOR MANUFACTURE OF SAME

BACKGROUND OF THE INVENTION

The present invention relates to magnetically actuated reed switch assemblies, and particularly to such a reed switch assembly having a desired level of sensitivity to the magnetic field of an actuating magnet and an improved method for manufacture of such a switch assembly.

Holce U.S. Pat. Nos. 4,210,888 and 4,213,110 disclose "wide gap" magnetic reed switch assemblies, in which a magnetic reed switch is accompanied by a helper magnet which provides a portion but not all of the magnetic flux density required to actuate the magnetic reed switch. The amount of magnetic flux density provided by the helper magnet is too small to keep the magnetic reed switch in a magnetically actuated state, but allows an actuating magnet to operate the switch at a greater distance than otherwise would be possible. Holce further discloses the adjustment of the sensitivity of the switch assembly to provide actuation when an actuating magnet is separated from the reed switch assembly by a desired distance, by adjusting the position of the helper magnet longitudinally of the reeds of the reed switch.

The manufacture of the reed switch assemblies disclosed in each of the Holce patents just mentioned requires some adjustment of the position of the helper magnet relative to the reed switch, in order for the switch assembly to perform its function in the most desired manner. That is, some adjustment of the helper magnet position is necessary to provide that the reed switch will become magnetically actuated when a properly polarized and oriented permanent actuating magnet of the proper size is located at a desired distance from the reed switch assembly. Such adjustment of the position of the helper magnet is also important in order to ensure that the reed switch not latch. That is, the magnetic reeds should separate and again become unactuated when the actuating magnet is withdrawn to a distance from the magnetic reed switch assembly.

Magnetic reed switches are particularly well adapted for use in burglar alarm sensing circuits and other proximity sensing applications, since their encapsulated structure and small size make it possible to mount such switches unobtrusively, and because a switch assembly including such a magnetic reed switch can be made to be sensitive to the magnetic field of a relatively small permanent magnet carried on a movable object such as a door, gate, or window whose unauthorized movement is to be detected by the alarm system, or on a moving element of a machine whose operation is to be controlled by a circuit including the reed switch.

Magnetic actuation of a magnetic reed switch requires a magnetic flux density which an actuating magnet acting alone can provide only when the actuating magnet is relatively close to the switch assembly. When a helper magnet is located very close to the reed switch it can provide a portion of the magnetic flux density required for magnetic actuation of the reed switch and thus allow a wider gap between the switch and an actuating magnet. In some applications it is highly desirable to have a magnetic reed switch remain magnetically actuated, despite inconsequential amounts of movement of a gate, door, or other moving member carrying the actuating magnet for the switch, in order, e.g., to avoid false alarms resulting from normal movement caused by wind or other causes short of an unauthorized entry, where the magnetic reed switch is part of a burglar alarm system.

It is also desired to be able to actuate a magnetic reed switch and maintain it in a magnetically actuated state without the need for particularly large actuating magnets. While these performance objectives are attained in switches manufactured in accordance with the Holce patents mentioned, proper adjustment of the position of the helper magnet during manufacture of such switches takes time and requires trained workers.

It is therefore desired to provide a magnetic reed switch assembly having capabilities equivalent to those achieved by the devices of Holce U.S. Pat. Nos. 4,210,888 and 4,213,110, with respect to the distance at which an actuating magnet may be separated from the switch assembly, and to manufacture such a switch assembly at a cost which is less than that of previously known magnetic reed switch assemblies including helper magnets.

SUMMARY OF THE INVENTION

The aforementioned objectives are attained and the shortcomings of the prior art magnetic reed switch assemblies are overcome in a "wide gap" magnetic reed switch assembly according to the present invention, in which a helper magnet is attached to a magnetic lead which typically is an extension of a magnetic reed in an encapsulated magnetic reed switch. By using uniformly configured reed switches which are selected within close tolerances on the basis of the amount of magnetic flux density required to cause magnetic actuation, as well as the required reduction in flux density which will allow the reed switch to drop out from a magnetically actuated state, an amount of magnetic flux which is insufficient to actuate the reed switch and insufficient to retain the reed switch in a magnetically actuated state can be provided for each of such selected reed switches by similar small permanent helper magnets of a uniform appropriate size, shape, and material. Such a helper magnet, which may be a small bar magnet, need only be placed on a magnetic lead of each reed switch in a particular easily identifiable location, without further adjustment, to provide the desired separation distances, between the reed switch and an actuating magnet, at which the reed switch will reliably be actuated magnetically or will reliably drop out of an actuated state in response to change in separation between the reed switch and the actuating magnet.

In accordance with the method of the invention, then, a helper magnet of an appropriate selected size is fastened to a magnetic lead of a reed switch of selected configuration and magnetic flux requirements, preferably by use of an adhesive to fasten the helper magnet to the magnetic lead immediately adjacent an end of the small glass envelope supporting and protecting the magnetic reed or reeds. Since assembly requires no adjustment of the helper magnet's position relative to the reed switch it can be accomplished quickly and easily by an assembler with much less training than was required for assembly of similarly capable switches in accordance with the previously mentioned Holce patents.

After assembly, each reed switch and helper magnet assembly is tested to ascertain that it does become actuated or unactuated at the appropriate distances from an actuating magnet.

In another embodiment of the invention a helper magnet of easily shaped, permanently magnetizable material is provided in a shape defining a bore. Such a helper magnet is attached to a magnetic reed switch by extending a magnetic lead connected to a magnetic contact of the reed switch through the bore defined in the helper magnet material. Thereafter, the helper magnet is permanently magnetized, so as to have an axis of magnetic polarity extending parallel with the magnetic lead and reed, and with a predetermined polarity.

The magnetic lead, in one embodiment of the invention, extends back around the helper magnet and lies alongside the helper magnet and the magnetic reed, extending to the location where the opposite magnetic reed contacts overlap and are magnetically attracted to one another. The magnetic lead acts thus as a shunt for the magnetic flux of the helper magnet, and concentrates the magnetic field of the helper magnet in the vicinity of the overlapping portions of the magnetic contacts of the reed switch. Because the helper magnet is in close contact with the magnetic lead, the magnetic field of the helper magnet is substantially symmetrically arranged about the magnetic reed and is closely linked with the magnetic reed. The field strength required of the helper magnet is thus reduced to a minimum consistent with its location external of the capsule containing the magnetic contacts of the reed switch.

In accordance with the method of the invention, small generally cylindrical pieces are cut from a sheet of magnetic material including finely powdered particles of permanently magnetizable material embedded in a matrix of flexible rubber-like material, or may be pressure molded in the desired shape in a plastic or nylon material which includes such powdered magnetizable material. The cylindrical pieces are provided with a longitudinal central bore, and a magnetic lead of a magnetic reed switch is placed through the bore so that the magnetic material resides as a helper magnet immediately adjacent but outside the glass envelope containing and supporting the magnetic reeds of the reed switch. Thereafter, the magnetic lead may be bent back around the outside of the helper magnet and parallel with the magnetic reed, but outside the glass capsule containing the magnetic reed, to a point alongside the overlapping portions of the magnetic reed contacts (or single reed and another magnetic contact) within the capsule.

After attachment of the helper magnet to the magnetic lead of the reed switch, the helper magnet is magnetized to a predetermined level of magnetization which is calculated to produce a significant portion of the magnetic flux density required for actuation of the magnetic reed switch, but which produces too little magnetic flux density to retain the reed switch in a magnetically actuated state once it has been magnetically actuated. Preferably, several magnetic reed switches will be assembled with small helper magnets and magnetized simultaneously as a batch, after which performance of each magnetic reed switch assembly can be tested. Those switch assemblies which latch, or others which require an actuating magnet to be brought undesirably close, are rejected, so that the helper magnets on those magnetic reed switch assemblies can be remagnetized to a more appropriate level of magnetization.

Alternatively, the bored helper magnets can be magnetized with another highly permeable core in the bore of each during magnetization. In either case, the result, because of the action of the lead or core to carry lines of flux during magnetization, is that the radially inner portion of the helper magnet has a higher reluctance equivalent to a small air gap between the inside of the bore and the magnetic lead of a reed switch, but the helper magnet can mechanically fit closely around the lead of the reed switch to maintain its proper location. The provision of some reluctance between the helper magnet and the magnetic lead helps to prevent the reed switch from having a tendency to latch undesirably in a magnetically actuated state.

It is therefore a principal object of the present invention to provide a magnetic reed switch assembly which is sensitive enough that it can be magnetically actuated by an actuating permanent magnet at a relatively large distance, at a lower cost than has previously been possible.

It is another important object of the present invention to provide a magnetic reed switch assembly, including a helper magnet, in which the reeds do not magnetically latch, yet in which only a small increase in magnetic flux density is required to cause magnetic actuation of the switch.

It is yet a further object of the present invention to provide a method for reliably producing a sensitive magnetic reed switch assembly at a lower cost than has previously been possible.

An important feature of a reed switch assembly according to the present invention is the attachment of a small helper magnet to a standard location on a magnetic lead to which a magnetic reed is attached, on the exterior of a reed switch capsule.

An important feature of a magnetic reed switch assembly embodying the present invention is the presence of a small helper magnet defining a central bore to receive a magnetic lead to which a magnetic reed is attached.

It is another important feature of the present invention that it teaches a method of manufacturing a magnetic reed switch assembly in which a helper magnet is first magnetized after assembly with the reed switch.

It is another feature of the method of the invention that a requirement for helper magnet adjustment is eliminated by preselection of reed switches and helper magnets within close tolerances and use of the exterior of a reed switch capsule as a reference for locating the helper magnet.

It is yet a further feature of the present invention that in one embodiment of the invention a magnetic lead extends through a helper magnet and thence to the vicinity of the overlapping magnetic contacts of the reed switch, thus shunting the magnetic field of the helper magnet and concentrating it in the vicinity of the magnetic contacts.

A principal advantage of the present invention is that it provides a magnetic reed switch assembly incorporating less expensive materials and requiring less labor for production than previously known switch assemblies of the same type.

It is another important advantage of the present invention that it provides a method for manufacturing reed switch assemblies in large numbers at lower cost yet with equal uniformity.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
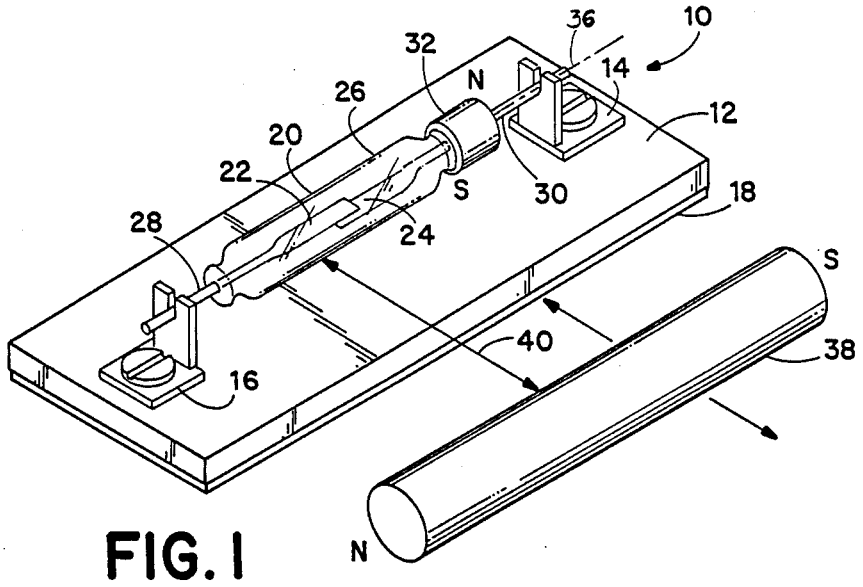
FIG. 1 is a perspective view of a switch assembly according the present invention, together with an actuating magnet therefor.
Figure 2:
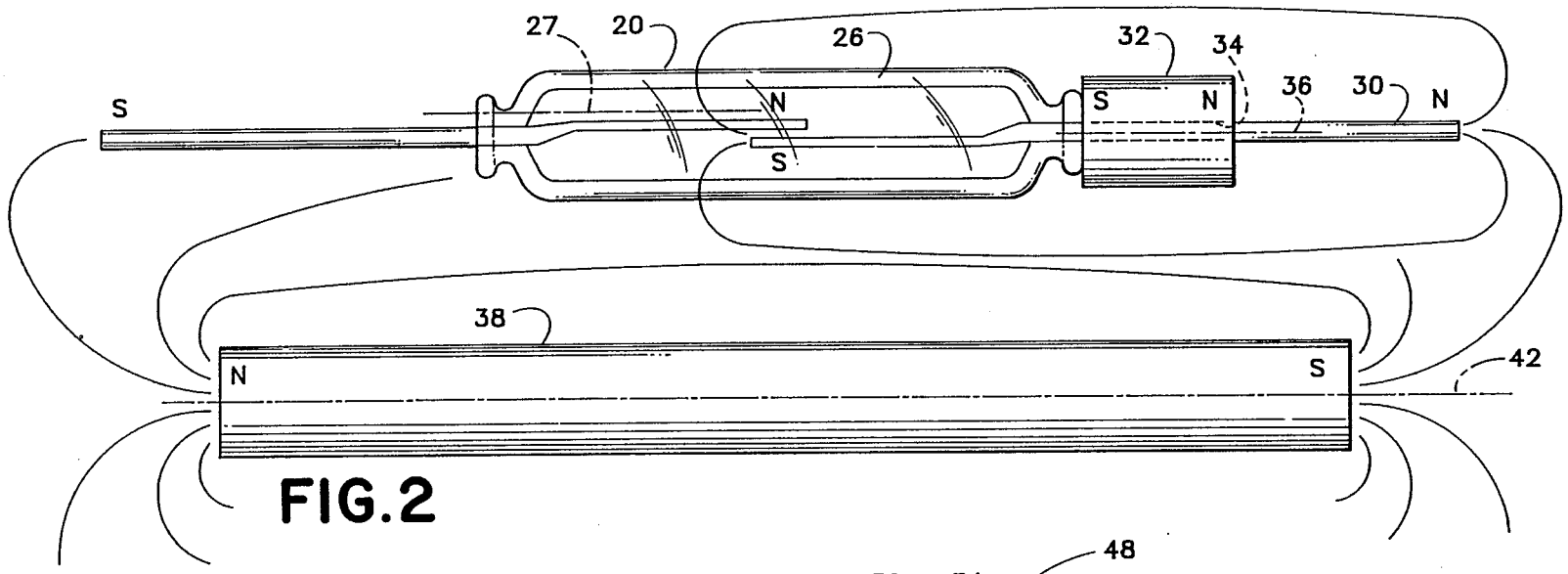
FIG. 2 is a schematic view of the switch assembly shown in FIG. 1, at an enlarged scale.

Referring now to FIGS. 1 and 2 of the drawings a reed switch assembly 10 embodying the present invention includes a base plate 12 supporting a pair of terminal post end support members 14 and 16. Each of the terminal post end support members 14 and 16 includes a terminal, such as a screw post, for use in connecting the switch assembly to electrical conductors of a circuit, such as a burglar alarm circuit in which the reed switch assembly 10 would usually be mounted in a fixed location, as on a window frame or doorway frame. For the purpose of attachment of the reed switch assembly 10 in such a location, a layer of an adhesive-coated plastic foam tape 18 is connected to the bottom of the base plate 12.

An encapsulated reed switch 20 of well-known design includes a pair of elongate flexible magnetic reeds 22, 24 each defining its own longitudinal axis and supported by and contained within a glass capsule or envelope 26 which is filled with an inert gas to prevent oxidation of the reeds 22 and 24. For example, suitable magnetic reed contacts of 120 volt, ½ ampere, and 15–20 ampere-turns rating are available from Standex Electronics (U.K.), Ltd., as contacts number GR-560. The longitudinal axes of the reeds 22, 24 are generally coincident with the central longitudinal axis 27 of the envelope 26. Extending from the reed 22 is a lead 28, and extending from the reed 24 is a lead 30, both of the leads 28 and 30 being extensions from the reeds 22 and 24 and made of the same magnetically permeable material. The lead 28 is electrically and mechanically fastened to the terminal end support member 16, while the lead 30 is similarly mechanically and electrically connected to the terminal end support member 14 to support the reed switch 20.

A small helper magnet 32 which is generally cylindrical in shape, defines a bore 34. The magnetic lead 30 extends through the bore 34, and the helper magnet 32 is retained in a location as close as possible to the end of the glass envelope 26 by a suitable adhesive (not shown). The helper magnet 32 is magnetized to have magnetic poles at its opposite ends, defining an axis of polarity 36 located within and parallel with the bore 34 and with the lead 30 which extends through the bore.

The reed switch 20 is of the well-known normally-open variety, and the overlapping contact portions of the reeds 22 and 24 are normally separated from one another by a small distance. A sufficiently strong magnetic field, however, causes them to attract each other magnetically with sufficient force to bend one or both of the reeds 22 and 24 elastically until physical contact occurs, closing the reed switch 20 electrically, so long as sufficient magnetic flux density is present.

The magnetic reed switch 20 is chosen to have a requirement for a predetermined magnetic flux density, referred to as an actuating flux density, to cause magnetic actuation, in a preferred embodiment of the invention. The helper magnet 32, because of its location surrounding the magnetic lead 30, is able to provide a large portion of that required magnetic flux density in the vicinity of the reeds 22 and 24, despite the small size of the helper magnet 32. The remaining amount of magnetic flux density necessary to actuate the reed switch 20 magnetically is provided by an actuating magnet 38, which may be a bar magnet of permanently magnetizable material, preferably a material such as an Alnico alloy, capable of being magnetized to provide a relatively strong magnetic field from a relatively small amount of magnetic material. The actuating magnet 38 may be mounted upon or within the frame of a door or window whose position is to be monitored by a burglar alarm system of which the magnetic reed switch assembly 10 is a part, or it may be carried by a part of a machine whose movement is monitored by an electrical circuit utilizing the switch assembly 10. Normally, a magnet housing is provided to contain and mount the actuating magnet 38 in a desired location, but such a housing does not form a part of the present invention and is therefore not shown herein.

Because the helper magnet 32 is located on the magnetic lead 30, it is magnetically coupled to the magnetic lead 30 and the reed 24, producing an induced magnetism in the lead 30 and the reed 24. It should be pointed out, however, that the magnetic force produced as a result of the magnetism induced by the helper magnet 32 is not sufficient to retain the magnetic reeds 22 and 24 in a magnetically actuated, electrically closed position without additional magnetic flux density from an outside source such as the properly oriented actuating magnet 38. Thus, when the actuating magnet 38 is brought within an actuating distance 40, properly aligned with the switch assembly 10, the combined magnetic flux of the helper magnet 32 and the actuating magnet 38 is great enough to create a magnetic force of attraction sufficient to close the reeds 22 and 24.

While the actuation distance 40 is dependent upon the requirements of the reed switch, the strength of the helper magnet 32, and the strength of the actuating magnet 38, the actuation distance 40 will in any case be greater than the greatest distance at which the actuating magnet 38 would be able to cause magnetic actuation of the reed switch 20 without the presence of the helper magnet 32. Once the magnetic reed switch 20 has been magnetically actuated, however, keeping the reeds 22 and 24 in contact with one another requires a lesser amount of magnetic flux density than that required initially to cause the reeds 22 and 24 to move together.

The location of the helper magnet 32 on the lead 30 also results in a beneficial symmetric arrangement of the magnetic field, so that it makes little, if any, difference from which direction the actuating magnet 38 approaches, so long as the axis of polarity 42 of the actuating magnet 38 is kept substantially parallel with the axis of polarity 36 of the helper magnet 32.

Figure 3:
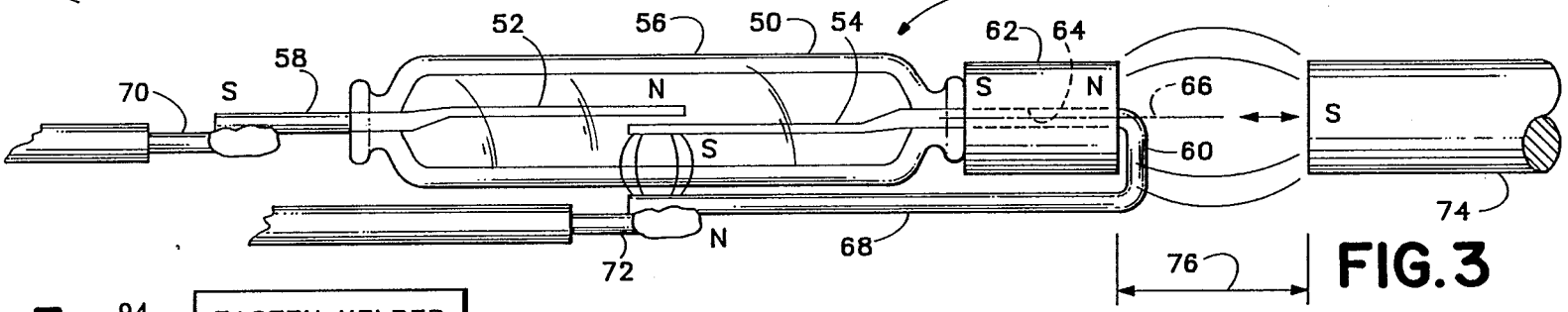
FIG. 3 is a view of a reed switch assembly which is an alternative embodiment of the present invention.

Referring to FIG. 3, a reed switch assembly 48 includes a reed switch 50 which is similar to the reed switch 20, including a pair of opposite reeds 52 and 54 contained in an envelope 56. Magnetic leads 58 and 60 support and extend from the reeds 52 and 54. A helper magnet 62 is similar to the helper magnet 32, and includes a bore 64 through which the magnetic lead 60 extends so that the helper magnet 62 surrounds the magnetic lead 60. The helper magnet 62 defines an axis of magnetic polarity 66 extending centrally within the bore 64 and from end to end of the helper magnet 62.

A portion 68 of the magnetic lead 60 is bent back in a U shape around and alongside the helper magnet 62 and closely alongside the envelope 56, extending to a position alongside the overlapping contact portions of the magnetic reeds 52 and 54. A pair of electrical conductors 70 and 72 are connected, respectively, as by soldering, to the ends of the magnetic leads 58 and 60 and extend side-by-side away from the magnetic reed switch 50, so that the magnetic reed switch 50 can conveniently be housed, for example, in a small cylindrical concealable housing with only a closed end of the cylindrical housing being exposed toward an actuating magnet 74 mounted, for example in a cylindrical housing (not shown) which can be mounted in a bore in the movable frame of a window or in the edge of a door, so that movement of the window frame or door to a particular position brings the actuating magnet 74 close enough to the reed switch 50 to provide the additional amount of magnetic flux density required to close the reed switch 50 magnetically.

The location of the portion 68 of the magnetic lead 60, extending around the helper magnet 62 and back toward the overlapping contacts of the magnetic reeds 52 and 54, shunts the magnetic flux circuit of the helper magnet 62 to the vicinity of the overlapping contact portions of the reeds 52 and 54. As a result, the helper magnet 62 need not be very large nor magnetized to a high degree, to be able to provide most of the magnetic flux density required to cause magnetic actuation of the switch 50 or retain the magnetic reeds 52 and 54 in contact with one another once they have been actuated magnetically. Nevertheless, it is still desired that the helper magnet 62 should not be capable of retaining the reed switch 50 in a magnetically actuated state.

Figure 4:
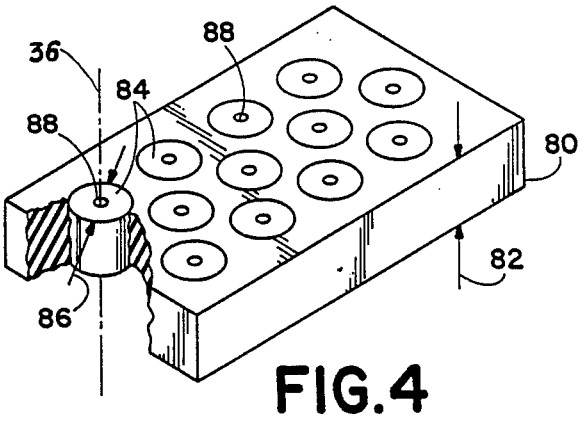
FIG. 4 is a perspective view of a piece of magnetic material, showing one manner of making helper magnets for use in the switch assemblies shown in FIGS. 1–3.

Referring to FIG. 4, a sheet of magnetic material 80, consisting of a high density of powdered barium ferrite or other similarly permanently magnetizable powdered material, physically supported and contained in a matrix of a rubber-like or moldable plastic material, has opposite parallel surfaces which define a thickness 82 and become the ends of a helper magnet such as the helper magnet 32 or 62. A preferred magnetic material of this type is available as Plastiform Magnetic Flexible Strip from Minnesota Mining and Manufacturing Company of Minneapolis, Minnesota. The material may be cut automatically, for example, using an appropriate laser cutting technique, to provide cylindrical pieces 84 each having an appropriate diameter 86 and an appropriate bore 88, corresponding to the bores 34 and 64 of the helper magnets 32 and 62. Once magnetized, even a very small helper magnet of the magnetic material held in a plastic or rubber-like matrix retains its magnetism better than an equivalent Alnico magnet.

Figure 5:
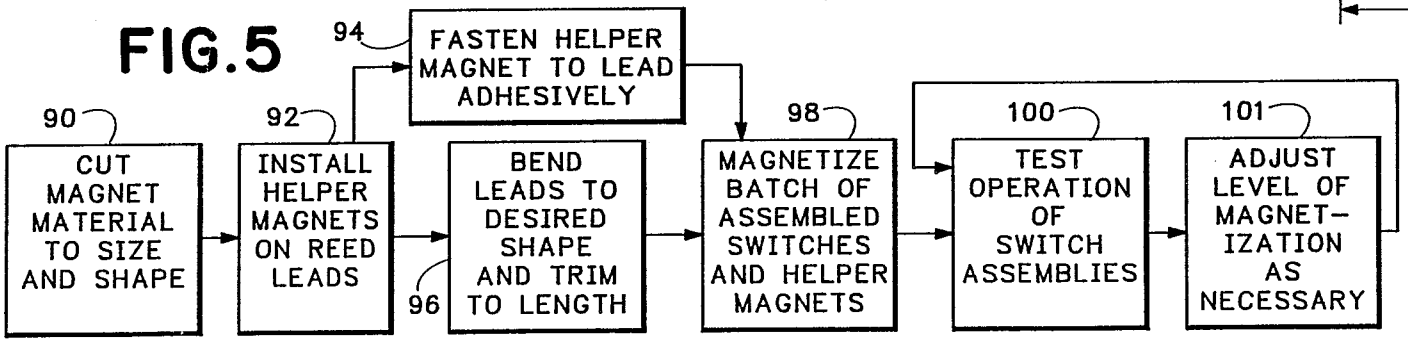
FIG. 5 is a block diagram of the method of manufacture of reed switch assemblies according to the present invention.

The method of the present invention, as shown in block diagram form in FIG. 5, results in manufacture of acceptable switch assemblies 10, 48, or the like, with a much lower expenditure of labor than has been required previously for "wide gap" magnetically actuated reed switch assemblies. In accordance with the invention, a desired number of magnetic reed switches such as the reed switches 20 and 50 are chosen to have a requirement, within suitable tolerances, for a certain number of ampere-turns of magnetic force to cause magnetic actuation, and to drop out of an actuated state when the magnetic field is reduced to a certain smaller number of ampere-turns. For each reed switch 20 or 50, an identical piece 84 is cut from magnetizable material 80 as described above and shown in FIG. 4 as step 90, to produce a helper magnet 32 or 62 of the size calculated to be large enough to produce all or nearly all of the magnetic flux density required to actuate the switch magnetically. These helper magnets are cut from the magnetic material 80 before it has been magnetized, and the helper magnet 32 or 62 is installed on an appropriate magnetic lead 30 or 60 of each magnetic reed switch, as step 92. The helper magnet is then fastened in place, either adhesively, as in the case of the reed switch assembly 10, step 94, or by bending the lead on which the helper magnet is located, as shown in step 96.

Once a plurality of magnetic reed switches 20, 50 and unmagnetized helper magnets 32, 62 have been assembled as explained above, they are placed together in a magnetizer, oriented so as to produce the desired axis of polarity 36 or 66 and the desired direction of polarity. They are subjected to a sufficient magnetic flux density to permanently magnetize each of the helper magnets to saturation, and then may be partially demagnetized to a predetermined percentage of saturation, step 98. The percentage of saturation is chosen to result in a magnetic force provided by the helper magnet 32 or 62 which is insufficient to retain the reeds of the respective switches 20, 50 in a magnetically actuated state, yet which requires only a small additional amount of flux density to be provided by an actuating magnet. As a result, an actuating magnet of a predetermined size and strength will cause actuation of the reed switch 20 or 50, respectively equipped with the helper magnet 32 or 62 having that predetermined percentage of saturation magnetism, at a predetermined actuation distance 40 or 76.

It has been discovered, however, that it is important to avoid too close a magnetic coupling, between the helper magnet 32 and the magnetic lead 30 or 60 of the reed switch 20 or 50. While it is desirable to keep the helper magnet small and physically located close to the magnetic lead of the reed switch, if the helper magnet is too closely coupled to the magnetically permeable lead, a reed switch equipped with such a helper magnet whose size and total magnetization are otherwise correct for the purposes of this invention may remain in a latched, magnetically actuated, condition after removal of an actuating magnet 38 or 74 from a position of close proximity to the reed switch and helper magnet, since the closed magnetic contacts 22 and 24 or 52 and 54 and closely coupled helper magnet can accept and retain a greater induced magnetism than a similar combination where the helper magnet is separated from the magnetic lead by a small air gap or its equivalent.

On the other hand, it is highly desirable to have a helper magnet that is as small as practical and which fits snugly on the magnetic lead, so that it is unnecessary to attach the helper magnet by potting or an adhesive to avoid excessive movement of the helper magnet, and resultant lack of reliability of performance of the switch assembly, when the magnetic lead is bent back alongside the reed switch envelope.

Figure 6:
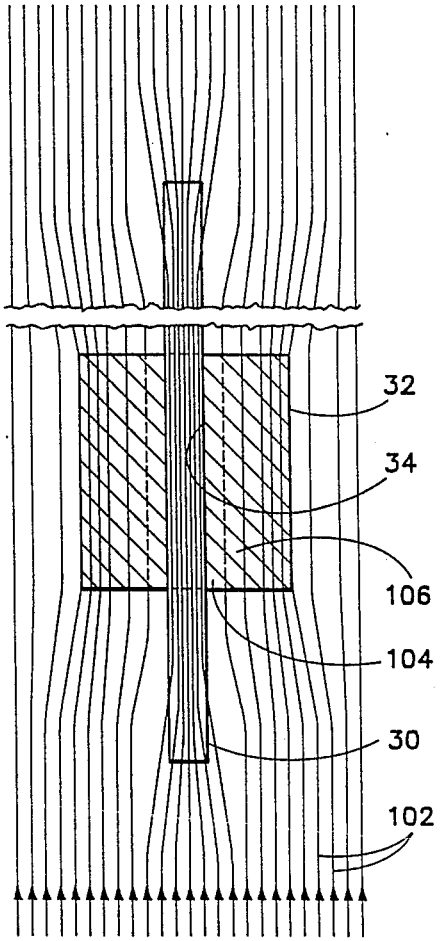
FIG. 6 is a schematic view, at an enlarged scale, of distribution of lines of force of a magnetizer during magnetization of a helper magnet such as that shown in FIG 1.

Furthermore, providing and maintaining an actual air gap of consistent size would require a way to hold a helper magnet in a desired location, because of the need for a bore 34 whose diameter is significantly larger than that of the magnetic lead. However, magnetizing a helper magnet 32 only while it is on the magnetic lead 30 or 60 of the reed switch results in the lead 30 acting as a magnetic shunt as shown in FIG. 6, freely conducting magnetic lines of force 102 which otherwise might magnetize the radially innermost portion 104 of the helper magnet 32, immediately surrounding the magnetic lead 30. The portion of the helper magnet 32 defining the bore 34 and extending a relatively small distance radially outward from the bore, is unmagnetized, or at least magnetized only to a lesser degree, because of this magnetic shunting effect during magnetization. This provides an annular zone of greater reluctance, corresponding to the portion 104 of the helper magnet, between the magnetized radially outward portion 106 of the helper magnet and the magnetic lead. As a result, the helper magnet 32, so magnetized, is not capable of acquiring and retaining enough additional flux to latch the magnetic reeds of the reed switch 20 simply as a result of being brought too close to the actuating magnet 38. In effect, the radially innermost portion 104 of the helper magnet 32, being magnetized at most to a smaller degree, acts as an air gap as well as a physical spacer with respect to the highly magnetized outer portion of the helper magnet.

Figure 7:
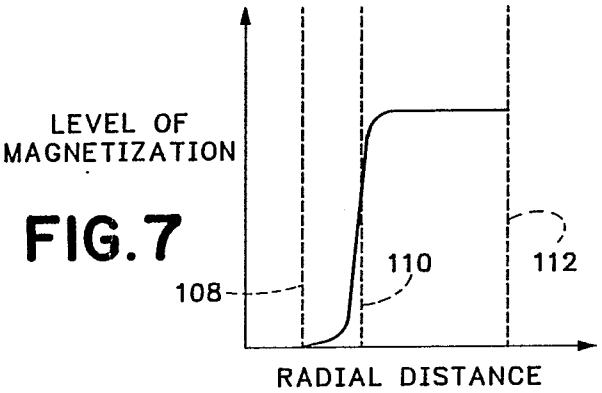
FIG. 7 is a graphic representation of the distribution of permanent magnetization levels within a helper magnet magnetized in accordance with the invention.

The resultant intensity of magnetization of the helper magnet 32 varies with radial distance from the center of the helper magnet as shown in FIG. 7, where line 108 indicates the radius of the bore 34, line 110 represents the radius of the outer limit of the inner portion 104, and lines 112 represents the outer surface of the helper magnet 32. This same pattern of magnetization and orientation of the magnetic lines of force 102 in the helper magnet can also be obtained if a magnetically permeable core other than the lead 30 of the reed switch is present in the bore 34 of the helper magnet during the process of magnetization, but magnetization using such a different core instead of the reed switch lead 30 would require polarity to be determined and observed during assembly of the helper magnets onto the appropriate magnetic lead of a reed switch.

Once the switch assemblies including such helper magnets have been magnetized, each of the switch assemblies is tested individually to determine whether it becomes magnetically actuated when an actuating magnet approaches to the proper actuation distance, and whether it drops out of magnetic actuation when the actuating magnet is removed to a predetermined distance, step 100. Those reed switches and helper magnets which do not fall within the predetermined specifications are adjusted by being remagnetized to a more appropriate percentage of saturation magnetization of the helper magnet, step 101, after which testing is repeated.

For example, for a reed switch 50 rated at 18 ampere-turns, ±20% tolerance, and including an envelope 56, 0.560 inch long, and having a magnetic lead 60, ¾ inch long and 0.021 inch in diameter, such as the GR-560 available from Standex Electronics (UK), Ltd, which has a U.S. sales headquarters located in Cincinnati, Ohio, magnet 62 is prepared from a sheet 80 of a barium ferrite magnetic material available from 3-M Company, as its D-0.125-3.000-N flexible magnet stock. The magnet 62 so prepared has a cylindrical shape with a length of 0.125 inch, a diameter 84 of 0.115 inch, and a central bore 0.025 inch in diameter. After the lead 60 is placed through the bore and the portion 68 is bent to lie alongside the overlapping contact portions of the reeds 52 and 54, the switch is magnetized in a suitable magnetizer such as a capacitive discharge magnetizer by being subjected to a very intense magnetic energy pulse to saturate the helper magnet 62.

Thereafter, a magnetic flux field equivalent to approximately 3 ampere-turns was required to cause actuation of the reed switch assembly 18, and deactivation occurred with a permanent actuation magnet removed to the desired distances. This method has been successful in more than 99% of the switch assemblies so prepared when rigorous process controls are maintained.

The method of the present invention provides acceptable switch assemblies with a simpler assembly procedure, yet results in a high percentage of acceptable switch assemblies without adjustment of the level of magnetization of the helper magnets and without requiring skilled personnel to test and adjust the location of a helper magnet which has already been magnetized.

It will be understood that the present invention is also applicable to a normally-closed magnetic reed switch, or a single-pole-double-throw magnetic reed switch in which magnetic actuation causes one pair of contacts to open, the differences between the normally-open reed switch and such normally-closed or single-pole-double-throw switches being unrelated to the present invention.

Figure 8:
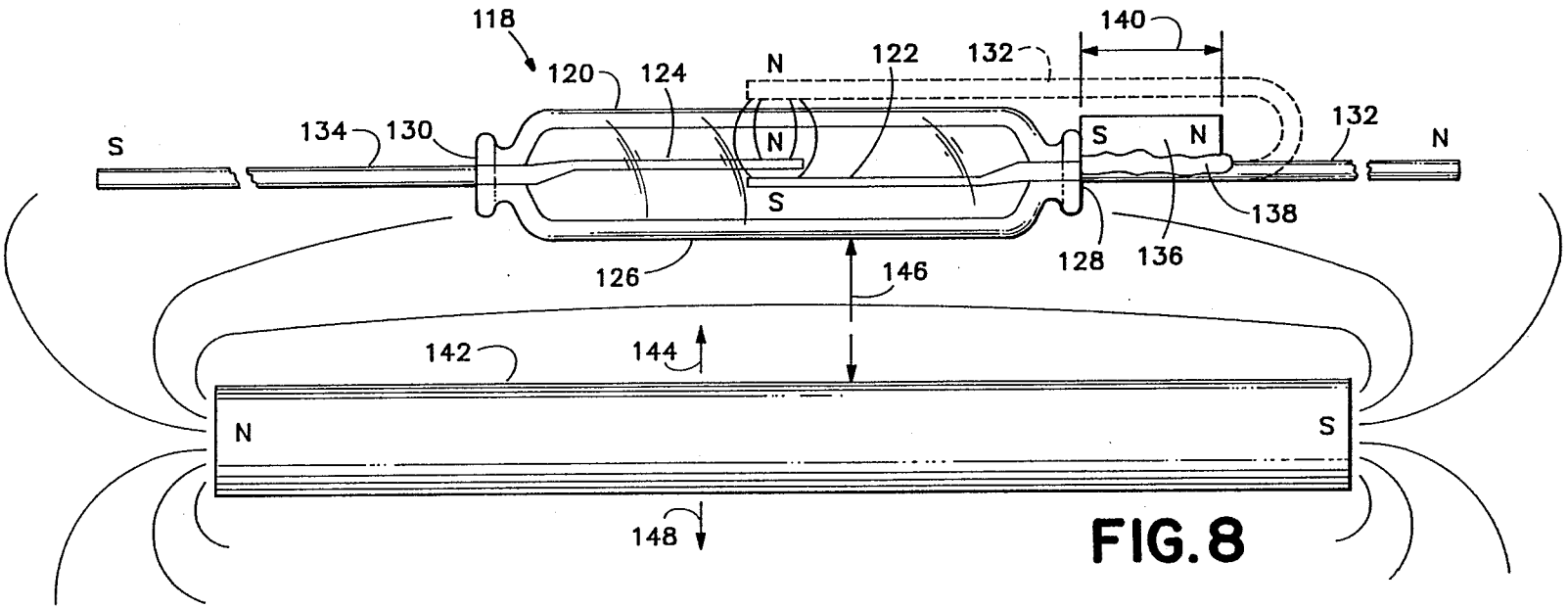
FIG. 8 is a view, at an enlarged scale, of a reed switch assembly which is another embodiment of the invention, together with an actuating magnet.

Referring now to FIG. 8 of the drawings, in another embodiment of the invention a reed switch assembly 118 according to the invention includes a reed switch unit 120 of a well-known type having a pair of flexible magnetic reeds 122 and 124 contained within and supported by a small glass envelope 126 having a pair of opposite ends 128 and 130. The reeds 122 and 124 are flattened extensions of magnetic leads 132 and 134, respectively, which are sealingly held and supported by the respective ends 128 and 130 of the glass envelope 126, with the distal ends of the reeds 122 and 124 overlapping each other and being spaced a small distance apart from each other. A sufficiently strong magnetic attraction can cause the reeds 122 and 124 to flex toward one another, bringing the reeds 122 and 124 into physical and electrical contact with one another, as is well known in the magnetic reed switch art.

A small helper magnet 136 is located outside the envelope 126 on the magnetic lead 132 which supports and is electrically connected with the magnetic reed 122. The helper magnet 136 holds itself on the lead 132 magnetically, but, for greater security, it is also attached to the lead 132 by an adhesive 138, which ensures that the helper magnet 136 remains in its position closely adjacent the magnetic lead 132 and closely adjacent the end 128 of the glass envelope 126, as shown, for reasons which will become apparent presently. A quickly acting adhesive such as one based on cyanoacrylate is preferred.

The helper magnet 136 is of a bar magnet configuration, polarized longitudinally as indicated by the letters "S" and "N," and should be of a permanently magnetizable material which is capable of maintaining its magnetization over a long period of time, at least when in close proximity to magnetically permeable material such as the lead 132 which can act as a keeper. For example, the helper magnet 136 may be of a sintered Alnico alloy available from Arnold Engineering of Ogallala, Nebr., which has been magnetized to saturation before attachment to the magnetic lead 132 of the reed switch 120. For a reed switch 120 which, like the reed switch 20, is a number GR-560 magnetic reed contact rated at 120 volts, one-half ampere, and 15–20 ampere-turns, available from Standex Electronics (U.K.), Ltd., a helper magnet 136 of such sintered Alnico material having a length 140 of ⅛ inch and a cross-section of 1/16th inch square, provides sufficient magnetic density in the vicinity of the reeds 122 and 124 to enable an actuating magnet 142 approaching the reed switch assembly 118 as indicated by the arrow 144 to cause magnetic actuation at a predetermined distance 146.

Nevertheless, the helper magnet 136 does not provide enough magnetic flux density surrounding the reeds 122 and 124 to prevent them from separating when the actuating magnet 142 is moved away from the reed switch assembly 118, as indicated by the arrow 148, to a desired drop-out distance which is slightly greater than the actuation distance 146. As will be understood, an actuating magnet 142 which has a greater field strength will cause the reed switch assembly 118 to become magnetically actuated at a larger actuation distance 146, and will result in a need to remove the actuating magnet 142 to a greater drop-out distance before the magnetic reeds 122 and 124 will separate from contact with each other. The actuation distance 146 will, moreover, be greater than the distance within which the actuating magnet 142 would have to be brought to actuate the reed switch 120 without the helper magnet 136 being present. The helper magnet. 136 thus converts the reed switch 120 into a reed switch assembly 118 having a greater sensitivity and able to be actuated by the actuating magnet 142 at an actuating distance 146.

In accordance with the method of the present invention, reed switch assemblies 118 may be prepared in large numbers with the actuation distance 146 reliably within an acceptable range of values, assuming the use of uniformly similar actuating magnets 142. For example, actuation distances 146 within the range of 1.25 inch to 1.75 inch are reliably obtained when reed switch assemblies 118 of the type mentioned above are assembled by placement of helper magnets 136 of the type described above on the magnetic lead 132, in a position abutting against the end 128 or 130 of the glass envelope 126 of the reed switch 120 and securing the helper magnet 136 in place by the use of the adhesive 138, and using a saturated Alnico V actuating magnet 1.25 inch long and 0.25 inch in diameter.

Of key importance to the success of the method of the present invention, however, is the use of reed switches 120 which are uniform in size, in the magnetic flux density required to cause actuation, and in the magnetic flux density at which drop-out occurs. Furthermore, it is preferable that the difference in magnetic flux density, between that required for actuation and that at which drop-out occurs, be kept as small as practical.

In addition, in accordance with the method of the invention, the helper magnets 136 must also be uniform in size, shape, and strength, and must be small enough so that mere subjection to a strong magnetic field while in place on the magnetic lead 132 will not cause the helper magnet to retain sufficient magnetic flux density to keep the reed switch 120 magnetically latched in an actuated state.

It should also be appreciated that placement of a helper magnet 136 of the appropriate size must be uniform with respect to the reed switch for assembly according to the invention to result in uniform characteristics of the completed reed switch assembly 118. The required position of the helper magnet must be determined and is particularly critical when the configuration of a reed switch is not symmetric with respect to the glass envelope which supports at least one magnetic reed and another magnetic contact which may also be a flexible reed.

It will further be appreciated that, as described above in connection with the reed switch assembly 118, shown in FIG. 8, the magnetic lead 132 or 134 may be bent around to extend parallel with the exterior surface of the envelope 126 to provide concentration of the magnetic field of the helper magnet 136 in the vicinity of the overlapping portions of the reeds 122 and 124. The effects of such a configuration of the magnetic lead 132 or 134 must be considered in choosing the size of the helper magnet 136 to be used.

Assembly of uniform reed switches 120 and uniform helper magnets 136, with the helper magnets 136 attached in a uniform location on one of the magnetic leads results in production of acceptable reed switch assemblies 118 in large quantities at great savings of cost by the elimination of time which otherwise would be required for adjustment of the location of a helper magnet as disclosed in Holce U.S. Pat. No. 4,110,888.

As with the reed switch assemblies 10 and 48, testing of each completed reed switch assembly 118 will reveal whether the actuating distance 146, and a desired drop-out distance are provided, and whether the reed switch 120 will latch in an actuated state. Those reed switch assemblies 118 which do not perform satisfactorily upon testing can thereafter be demagnetized or remagnetized to bring their performance within the desired specifications while still assembled, as explained previously in connection with the reed switch assemblies 10 and 48.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is Claimed is:

1. A switch device for controlling an electrical circuit in response to the presence of a magnetic field of predetermined strength, said switch device comprising:

(a) a reed switch having a pair of contacts including at least one magnetic reed contained within an elongate capsule having a reed axis, said contacts being movable relative to one another from an unactuated state to a magnetically actuated state in response to the presence of a magnetic field of at least a predetermined minimum flux density;

(b) a magnetic lead extending outwardly from said capsule and connected electrically with one of said contacts and having a portion thereof aligned coaxially with said reed axis;

(c) permanent magnet means having an axis of polarity and associated with said magnetic lead, for providing a predetermined portion of said predetermined minimum flux density, said predetermined portion being less than a latching flux density required to retain said contacts in said magnetically actuated state;

(d) said permanent magnet means being located adjacent said magnetic lead so as to provide said predetermined portion of said predetermined magnetic field strength such that said axis of polarity is substantially parallel to said reed axis and said permanent magnet means is located adjacent an end of said elongate capsule; and (e) a portion of said magnetic lead extending beyond said permanent magnet means and thence being doubled back alongside and outside said capsule and extending to a position alongside at least a portion of said magnetic reed.

2. The switch device of claim 1 wherein said permanent magnet means has a shape defining a bore and has said axis of polarity parallel with said bore, said permanent magnet means being mounted on said switch device with said magnetic lead extending through said bore.

3. The switch device of claim 2 wherein said permanent magnet means is of a powdered magnetic material carried in a flexible matrix.

4. The switch device of claim 2 wherein said permanent magnet means is of a powdered magnetic material carried in a matrix of a moldable plastic material.

5. The switch device of claim 1, further comprising permanent magnet actuating means for providing an actuating magnetic field surrounding said reed switch for reinforcing the magnetic field of said permanent magnet means and actuating said switch device.

6. The switch device of claim 5 wherein said reed switch is of the normally-closed type, said electrical circuit being open when said reed switch is in said magnetically actuated state.

7. The switch device of claim 5 wherein said reed switch is of the normally-open type, said electrical circuit being closed when said switch is in said magnetically actuated state.

8. The switch device of claim 5 wherein said reed switch is of the single-pole-double-throw type.

* * * * *